US007549459B2

(12) United States Patent
Sun

(10) Patent No.: US 7,549,459 B2
(45) Date of Patent: Jun. 23, 2009

(54) FILM METAL MOULD CRYSTALLIZER AND METHOD FOR CASTING USING THE SAME

(75) Inventor: Jingen Sun, Beijing (CN)

(73) Assignee: Beijing TaiHe Technology Co., Ltd, Beijing (CN)

( * ) Notice: Subject to any disclaimer, the term of this patent is extended or adjusted under 35 U.S.C. 154(b) by 600 days.

(21) Appl. No.: 10/561,663

(22) PCT Filed: Jun. 2, 2004

(86) PCT No.: PCT/CN2004/000586

§ 371 (c)(1),
(2), (4) Date: Dec. 16, 2005

(87) PCT Pub. No.: WO2004/110672

PCT Pub. Date: Dec. 23, 2004

(65) Prior Publication Data

US 2007/0095498 A1 May 3, 2007

(30) Foreign Application Priority Data

Jun. 19, 2003 (CN) ..... 03 1 37670

(51) Int. Cl.
*B22D 15/00* (2006.01)
*B22D 27/04* (2006.01)

(52) U.S. Cl. ..... 164/342; 164/348

(58) Field of Classification Search ..... 164/271, 164/342, 348, 122, 122.1, 128
See application file for complete search history.

(56) References Cited

U.S. PATENT DOCUMENTS 3,887,157 A * 6/1975 Apatoczky ..... 164/444

* cited by examiner

*Primary Examiner*—Kevin P Kerns
(74) *Attorney, Agent, or Firm*—Jiawei Huang

(57) ABSTRACT

A crystallizer and method for casting using the crystallizer. The crystallizer mainly includes a plurality of-position-limiting parts (16) on the inner side of the mould seat (6, 7). The inner side of the position-limiting parts (16) is in correspondence with the external periphery of the mould wall (8-1, 9-1) of the film mould (8, 9). A medium channel (17) with a medium-supplying port (5) at its upper end is formed between the adjacent position-limiting parts (16).

15 Claims, 16 Drawing Sheets

E–E

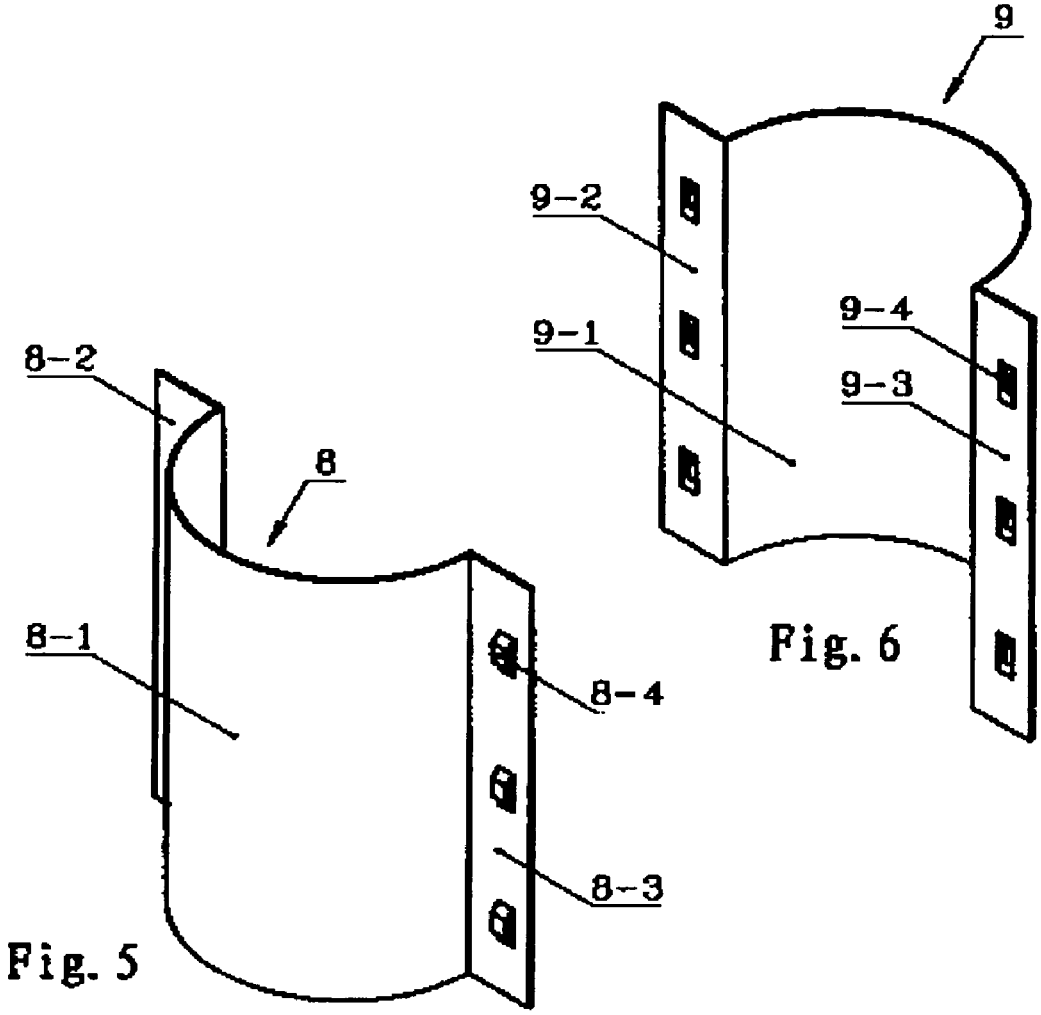
Fig. 6
Fig. 5
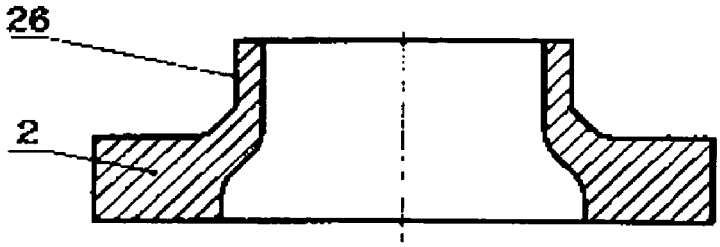
Fig. 7

FILM METAL MOULD CRYSTALLIZER AND METHOD FOR CASTING USING THE SAME

BACKGROUND OF THE INVENTION

1. Field of the Invention

This invention relates to a crystallizer and method for casting using the same, mainly in casting of middle and low melting point metals, such as aluminum, magnesium, copper and tin, and their alloy, in particular for use in bottom or bottomless tubular casting of these metal castings, especially in casting of aluminum pistons.

2. Description of the Prior Art

In metal casting, rapid, bottom-top, sequential crystallization is an ideal mode of crystallization. If it is possible to complete the casting crystallization in this way, there is almost zero defects in the resulting casting. The external condition for achieving the rapid, bottom-top, sequential crystallization is the rapid, bottom-top (thermal current goes from top to bottom), sequential thermal diffusion. Therefore, the rapid, bottom-top, sequential thermal diffusion is a process much sought after by casting technicians worldwide. However, the rapid, bottom-top, sequential thermal diffusion can be achieved with very few existing casting technologies, such as electroslag remelting, ingot continuous casting, molten tin infusion process, etc. These technologies have their evident limitations. Those of electroslag remelting and ingot continuous casting are only capable of producing ingot with unvaried shape of cross section, and incapable of making casting of varied shapes. Products made with the molten tin infusion process are so expensive that the process cannot be put into wide industrial application.

The Chinese patent application CN1098344A has disclosed "a device for casting film metal mould and method for casting using the same", with its configuration as shown in FIG. 25, which comprises a flask 90 , a film metal mould 91 , a spraying nozzle 92 , a pull bar 93 and a roof plate 94. This technology has realized the film mould casting, by using spraying nozzle 92 to spraying cooling medium from bottom to top on the outer wall of film metal mould 91 to perform rapid, from bottom to top, sequential thermal diffusion of casting 88 so as to guide the crystallization interface 89 to progress rapidly from bottom to top. Undoubtedly, this technology plays a positive role in making the process mature for the rapid, bottom-top, sequential thermal diffusion of casting. But it has its own drawbacks: (1) With the spaying method to cool down, the accuracy to control the moving speed of casting crystallization interface is not so precise that the internal quality of casting is still not satisfied. (2) The method of butt resistance welding to weld a plurality of pull bars 93 onto the outer wall of the film metal mould 91 , and the other end of the pull bar is fixed on the overall supporter, i.e., flask 90 , and film metal mould 91 is fixed through pulling force of the pull bars 93 and the resistance force of roof plate 94 . With few supporting points and uneven force on film metal mould, this way of fixing is apt to cause a large area of deformation; and the film metal mould is difficult to disassemble and assemble. These drawbacks call for urgent improvement.

SUMMARY OF THE INVENTION

The object of the present invention is to provide a metal film crystallizer which can provide the casting with rapid and sequential thermal diffusion and improve the internal quality of casting.

The other object of the present invention is to provide a method for casting using this crystallizer which can provide the casting with from bottom to top, rapid and sequential thermal diffusion and improve the casting quality.

The above objects of this invention can be achieved with the following technical solution: a crystallizer for casting low melting point metals and their alloy, comprising at least a base, an end mould, mould seats on the end mould, film moulds, a plurality of position-limiting parts arranged on the inner side of said mould seats in the radiation shape. The shape of the inner side of these position-limiting parts corresponds with that of the outer periphery of the mould walls of the film moulds. The inner periphery of mould walls corresponds with the outer periphery of the casting. Between the adjacent position-limiting parts is a vertical gap which forms a slot. The film moulds are fixed on the mould seats by the locating part so that the slot is closed to become the cycle passage of the cooling medium, i.e. medium channel; on the upper end of the medium channel there is a medium-supplying port and lower end of the medium channel is communicated with the drain pipe.

A plurality of position-limiting parts of present invention may be fixed on the inner side of the mould seats or formed with the mould seats as an integrated body.

A plurality of position-limiting parts may be further arranged on the inner side of the mould seats vertically.

The inner side of position-limiting part of present invention is cut by an cutter to form a fringe. The outer periphery of the cutter corresponds with the mould wall of the film mould. Particularly, the sectional shape of the fringe on the inner side of the position-limiting part is triangular which is truncated by the cutter. The length of truncate arc is 0.5~6 mm. The arc of the two adjacent fringes truncated by cutter is 2~50 mm long.

As a detailed embodiment of present invention, said cutter is cylindrical, whose surface corresponds with the outer periphery of the mould wall of the film mould.

The mould seat of present invention has at least two mould closing fits along the mould joint. Said film mould consists of the mould wall and the mould ear. The mould wall extends a width along the mould joint to form the mould ear, which is tightly pressed between the mould closing fits of the mould seat.

In the film mould of present invention may be arranged the locating parts which consists of a plurality of the inserting slots and pins.

The ratio of the thickness of the film mould to the diameter of the cylindrical casting is between 0.0015~0.006. In practical, if the calculated mould wall thickness of film mould is not standard data, it can be estimated to the standard thickness. The film mould is made of the martensite heat resistant steel.

The bottom parts of all the slots on the same mould base are communicated with a passage, and leads to a drain pipe.

Further, on the end mould may be arranged an upper part which correspond with the inner periphery of mould wall. The end mould is fixed on the mould base which can slide on the end mould; The cylinder cuts the lower part of the inner side of mould seats to form an inner bottom of the mould seat. The bottom of the film mould is clamped between the upper part and the inner bottom of the mould seat.

The radius of cylinder is R1, that of the inner bottom of the mould seat is R2, that of the upper part is R3, the outer diameter of the cylindrical casting is R4, and the thickness of film mould walls are δ. This invention will define their fit relations as follows:

$$R1=R2=R3+\delta=R4+\delta \quad \text{(Formula I)}$$

The parts, such as end mould, mould seats, film moulds and sand cores all take the base as foundation to effect installation relations. After the installation is completed, a mould cavity is formed; meanwhile, slots are closed to become the cooling medium passage, i.e. medium channel. At the upper end of the medium channel there is at least one medium-supplying port, the lower end of medium channel is communicated to the drain pipe. The drain pipe is communicated to a medium-discharging port through a soft pipe. The medium-discharging port is fixed in a liquid surface controller. Within the travel lower than the lower end of the medium channel and higher than its upper end, liquid level controller may stop at a pre-determined height or ascend or descend at a pre-determined speed.

In the relative position above the crystallizer is a pouring cup and a pouring ladle, which respectively have their own operating mechanism. The pouring ladle can also inverse with invert center as its axis while it ascends or descends. For the convenience of calculating the pouring rate, the radial sectional shape of the pouring ladle is designed into a sector to take the invert center as the center of circle. The pouring ladle inverses one degree, the poured melting metal is of a fixed amount. The speed at which the pouring cup and pouring ladle ascends and descends and the speed at which pouring ladle tilts and dumps are both controlled with the parameter.

To the crystallizer of the present invention may be added the metal mould between film moulds. Two Zones are cut away from each mould seat, and in such zones are added metal moulds; the inner-side shape of metal moulds and the inner circle of mould walls jointly form the peripheral shape of the tubular casting. Each metal mould has at least two sides, which are used as mould closing surface. Each metal mould contains a pinhole core bar in it, which can be pulled or pushed inside the metal mould.

Each mould ear is pressed tightly between the mould closing fits. The lower sections of mould walls are pressed tightly between the inner bottom of the mould seat and the upper part, the tension of the mould walls and anti-tension of the position-limiting parts form a pair of force couple for accurate locating, and to achieve rigidity, of the mould walls.

On top of the mould cavity are installed a top core and a top core operating mechanism. The top core is made of non-metal material or composite material, preferably of silicon nitride (SiN2). Close to the top core is disposed a heater.

According to the other aspect of the present invention, the present invention provides a casting method for tubular casting using the crystallizer of the present invention, comprising the following steps:

The melting stock is poured into the mould cavity of said crystallizer at the determined speed. Said determined speed must enable the melting stock liquid levels in the mould cavity to be higher than the cooling medium liquid level in the medium channel;

When the melting stock fills the bottom part of the mould cavity, and submerges the bottom end of pouring pipe up to 10~30 mm in depth, open the water supply box, and pour cooling medium into medium channel through a plurality of medium-supplying ports;

The value R of the longitudinal sections of the tubular casting controls the ascending speed of cooling medium liquid level, and R is the speed of the vertical movement of the casting crystal interface;

When the crystallization interface approaches the top of the tubular casting, reduce the value R of cooling medium liquid level or put value R at zero;

The pouring is over. After the casting crystallizes, stop supplying water. A medium-discharging port descends below the bottom end of the medium channel through liquid level controller, and exhausts the cooling medium in the medium channel.

After the cooling medium is exhausted in the medium channel, the crystallizer is kept in an intermediate state, and enters an air-cooling time period of 10 to 90 seconds. Then de-moulds, takes out the casting, and enters next cycle.

Said value R is obtained from calculation using the following formula, $$R=\cos\alpha(\lambda s G_{TS}-\lambda_{LGTL})/\sigma S\Delta h \quad \text{(Formula II)}$$

Wherein:

$\lambda s$—solid phase thermometric conductivity;

$\lambda_L$—liquid phase thermometric conductivity;

$G_{TS}$—temperature gradient of the horizontal unit length of the solid phase;

$G_{TL}$—temperature gradient of the horizontal unit length of the liquid phase;

$\sigma S$—solid phase density;

$\Delta h$—Latent heat of solidification;

$\alpha$—included angle between crystallization interface and horizontal level; and R—vertical movement speed (cm/second) of the crystallization interface.

When the top core is on top of the crystallizer mould cavity, the method of the present invention also comprises the following steps:

The heater heats the top core to keep its temperature above the temperature of the liquid phase point of the cast metal.

The operating mechanism is used to put the top core into the mould cavity before casting. After crystallization of the casting, the operating mechanism is used to de-mould top core, and put it into the heater to keep its temperature.

The method of the present invention uses the pouring cup with the pouring pipes to pour melting stock into the mould cavity, further comprising the following steps:

Stretch the pouring pipe of pouring cup to the bottom part of mould cavity before casting;

Casting begins. When the melting stock liquid level submerges the bottom end of the pouring pipe up to 10~30 mm in depth, the pouring cup and the pouring ladle are lifted at the same time, at a speed kept the same as the ascending speed of melting stock metal liquid levels. Before all the melting stock of one cycle is used up, the bottom end of the pouring pipe remains 10-30 mm below the melting stock liquid levels.

The radial sectional shape of the pouring ladle is designed into a sector, the invert unit angle of the pouring ladle corresponds to the weight of the melting stock poured out, and the speed at which melting stock liquid levels ascend is controlled by the speed of the inverse angle of the pouring ladle.

The tubular casting made with the technology of the present invention has the obvious positive effects as described below, taking the casting aluminum and silicon eutectic piston for example:

1. On any section of the aluminum piston cast with the technology of the present invention, pin-holes, and poriness are not found. Measured by Standard GB3508-83, the macro-organization is better than Grade 1. The macro-organization of the aluminum and silicon eutectic piston of the prior art is Grade 2~4.
2. The micro-organization of the aluminum piston cast with the technology of the present invention has evidently been improved. Measured by Standard JB/T8892-1999, its micro-organization is steadily shown at Grade 1, while the micro-organization of the eutectic piston casting of prior art is at Grade 2~4.

3. The iron phase inclusion of fishbone shape is of Grade 2. Measured by Standard JB/T51050-1999, the above three effects have render percentage of quality products of the aluminum and silicon eutectic pistons to be at >90%, while the percentage of that casting of prior art is 10~30%
4. It is not necessary to arrange shrink head and running channel for the aluminum piston cast with the technology of the present invention; hence the yield of the casting has been increased up to 75~90%, while that of the aluminum piston casting of prior art is somewhere between 40~60%. Thus this improvement has lowered the production cost by 20~30%.

BRIEF DESCRIPTION OF THE DRAWINGS

FIG. 5 shows one of the two film moulds in the embodiment of the present invention;

FIG. 6 shows the other one of the two film moulds in the embodiment of the present invention;

FIG. 7 is a section view of the end mould;

DETAILED DESCRIPTION OF THE PREFERRED EMBODIMENTS

Figure 1:
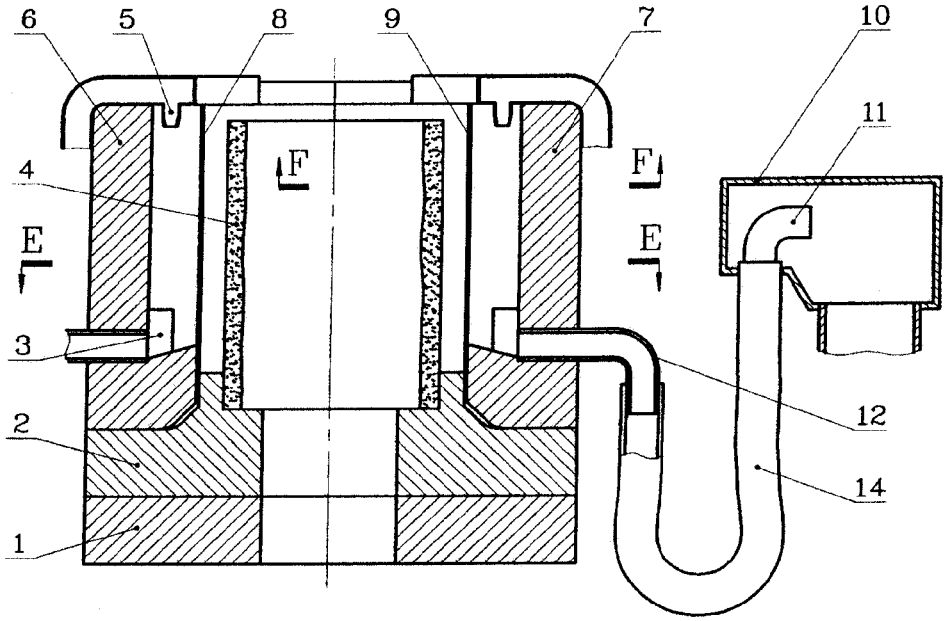
FIG. 1 is a section view of the crystallizer of the present invention.

Following is a detailed description, based on the drawings, of the preferred embodiments of the present invention.

As shown in FIGS. 1-22, the crystallizer of present invention includes at least a base 1, an end mould 2, mould seats 6 and 7 on the end mould 2, film moulds 8 and 9, a plurality of position-limiting parts 16 arranged on the inner side of said mould seats in the radiation shape. The shape of the inner side of these position-limiting parts corresponds with that of the outer periphery of the mould walls 8-1, 9-1 of the film moulds 8, 9. The inner periphery of mould walls 8-1, 9-1 corresponds with the outer periphery of the casting. Between the adjacent position-limiting parts is a vertical gap which forms a slot 17-1. The film moulds 8, 9 are fixed on the mould seats by the locating part so that the slot 17-1 is closed to become the cycle passage of the cooling medium, i.e. medium channel 17; On the upper end of the medium channel 17 there is a medium-supplying port 5 and lower end of the medium channel 17 is communicated with the drain pipe 12. Thus, with the cooling medium being poured into the medium channel, the crystallizer of present invention not only can achieve the bottom-top, sequential thermal diffusion of casting, but also can lead the crystallization interface to go forward rapidly and sequentially from bottom to top, thereby improving the internal quality; Further, a plurality of position-limiting parts 16 in the inner side of the mould seats 6, 7 can uniformly support and locate the film moulds 8, 9 from multiple positions to avoid the defects prone to deform in the prior art. In addition, the inner sides of a plurality of position-limiting parts jointly form the shape which corresponds with the outer periphery of the mould walls 8-1, 9-1 of the film mould 8, 9, which makes the film moulds 8, 9 locate through natural leaning without welding, and disassemble easily.

In the present invention, a plurality of position-limiting parts 16 may be fixed on the inner side of the mould seats 6, 7 or formed with the mould seats as an integrated body. There is no limitation here.

Figure 3:
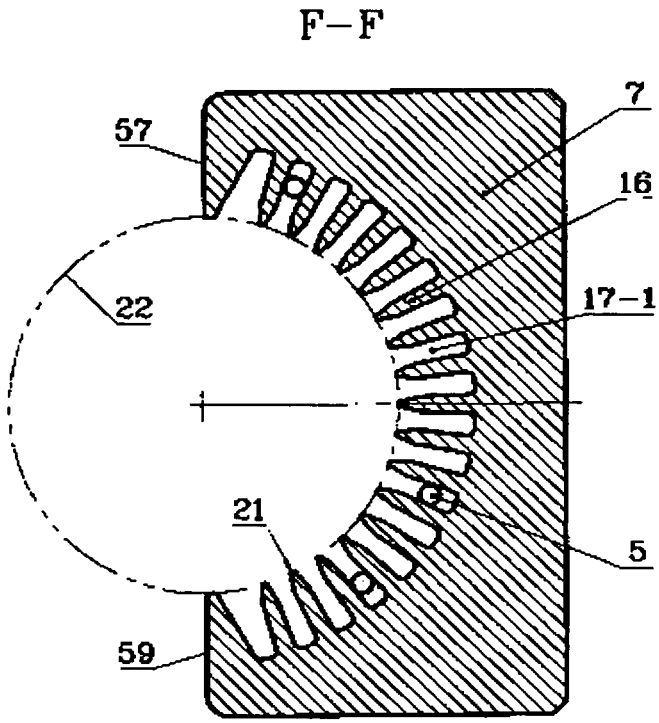
FIG. 3 is a section view along F-F in FIG. 1.
Figure 4:
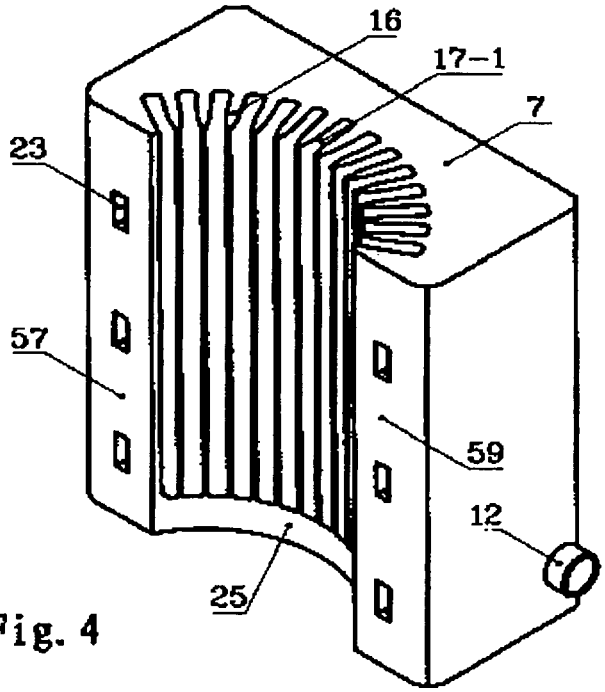
FIG. 4 is a perspective view of the mould seat.

As shown in the FIGS. 3 and 4, a plurality of position-limiting parts 16 may be further arranged on the inner side of the mould seats 6, 7 vertically.

In order to support the film moulds 8, 9 uniformly and avoid its deformation, the inner side of position-limiting part 16 is cut by an cutter for form a fringe 21. The outer periphery of the cutter corresponds with that of the mould wall 8-1, 9-1 of the film mould.

Figure 2:
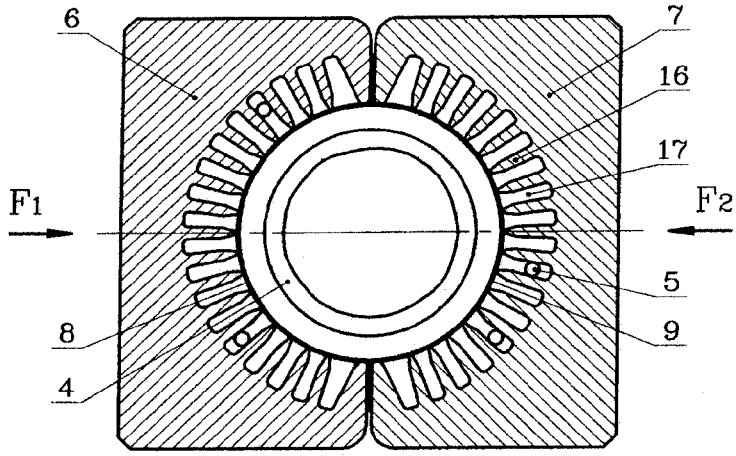
FIG. 2 is a section view along E-E in FIG. 1.

As a specific example shown in FIGS. 2 and 3, the sectional shape of the fringe 21 on the inner side of the position-limiting part 16 is triangle which is truncated by the cutter. The length of truncate arc is 0.5~6 mm. The arc of the two adjacent fringes truncated by cutter is 2~50 mm long.

The present invention provides a method for casting using said crystallizer, comprising the following steps:

(a) The melting stock 30 is poured into the mould cavity of said crystallizer at the determined speed. Said determined speed must enable the melting stock liquid levels 35, 38 and 76 in the mould cavity to be higher than the cooling medium liquid level 34 in the medium channel;

(b) When the melting stock fills the bottom part of the mould cavity, and submerges the bottom end of pouring pipe 28-1 up to 10~30 mm in depth, open the water supply box 72, and pour cooling medium 33 into medium channel 17 through a plurality of medium-supplying ports 5;

(c) The value R of the longitudinal sections of the tubular casting controls the ascending speed of cooling medium liquid level 34, and R is the speed of the vertical movement of the casting crystal interface;

(d) When the crystallization interface approaches the top of the tubular casting, reduce the value R of cooling medium liquid level 34 or put value R at zero;

(e) The pouring is over. After the casting crystallizes, stop supplying water. A medium-discharging port 11 descents below the bottom end of the medium channel through liquid level controller 10, and exhausts the cooling medium in the medium channel;

(f) After the cooling medium is exhausted in the medium channel, the crystallizer is kept in an intermediate state, and enters an air-cooling time period of 10 to 90 seconds. Then de-moulds, takes out the casting, and enters next cycle.

On any section of the aluminum silicon eutectic piston cast with the technology of the present invention, pin-holes, and poriness are not found. Measured by Standard GB3508-83, the macro-organization is better than Grade 1. Measured by Standard JB/T8892-1999, its micro-organization is steadily shown at Grade 1. Therefore, both the macro-organization and the micro-organization of the aluminum silicon eutectic piston cast is much better than that of prior art.

The vertical movement speed R of the crystallization interface of respective section of tubular casting is obtained from calculation using the following formula:

$$R=\cos\alpha(\lambda s G_{TS}-\lambda_{LGTL})/\sigma S\Delta h$$

Wherein:

$\lambda s$—solid phase thermometric conductivity;

$\lambda_L$—liquid phase thermometric conductivity;

$G_{TS}$—temperature gradient of the horizontal unit length of the solid phase;

$G_{TL}$—temperature gradient of the horizontal unit length of the liquid phase;

$\sigma S$—solid phase density;

$\Delta h$—Latent heat of solidification;

$\alpha$—included angle between crystallization interface and horizontal level; and The value R of respective section of longitudinal direction of the tubular casting may serve as the determined speed value of cooling medium liquid level 34.

Figure 9:
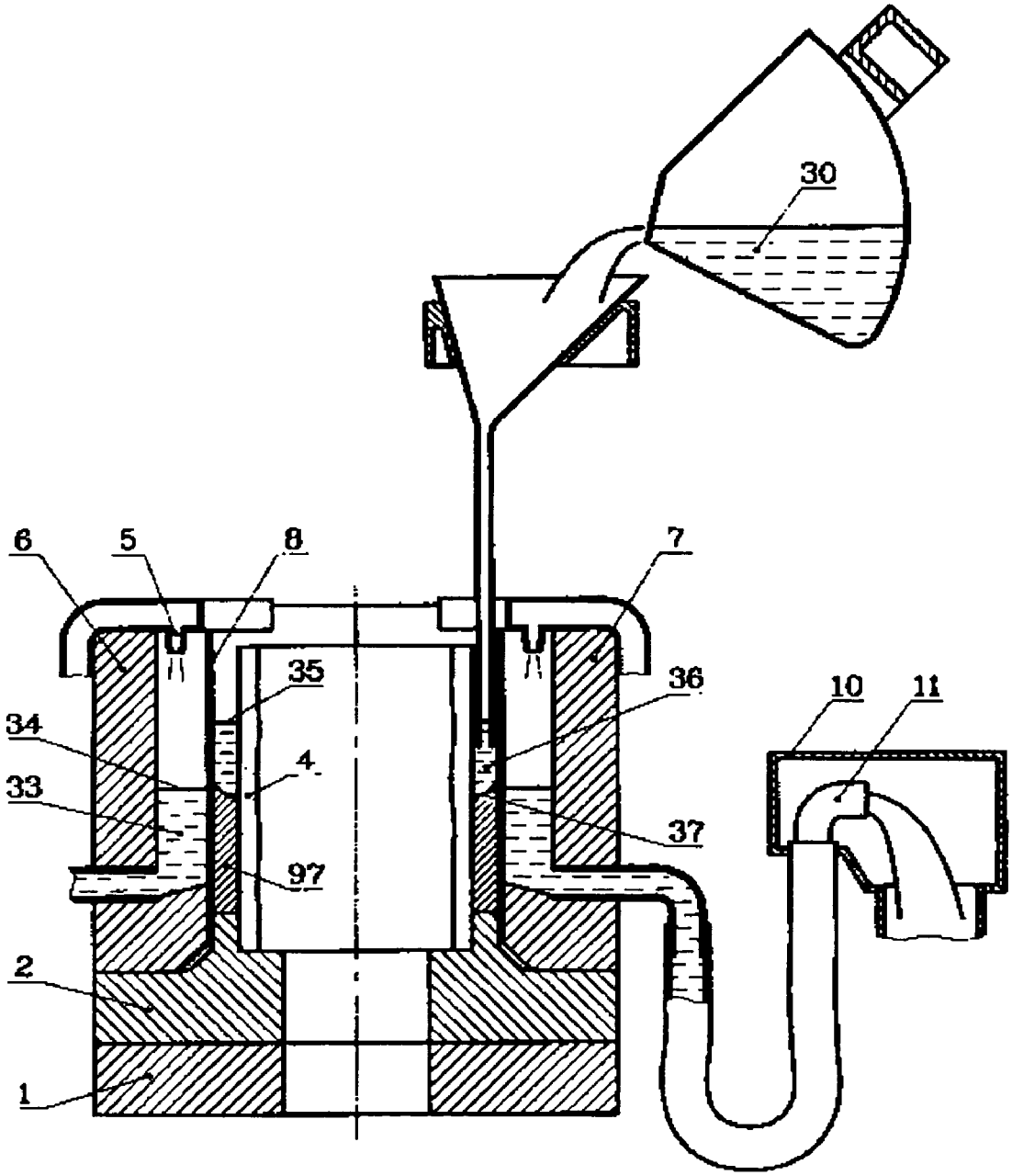
FIG. 9 is a schematic view of the process of crystallization of the typical bottomless tubular casting.
Figure 10:
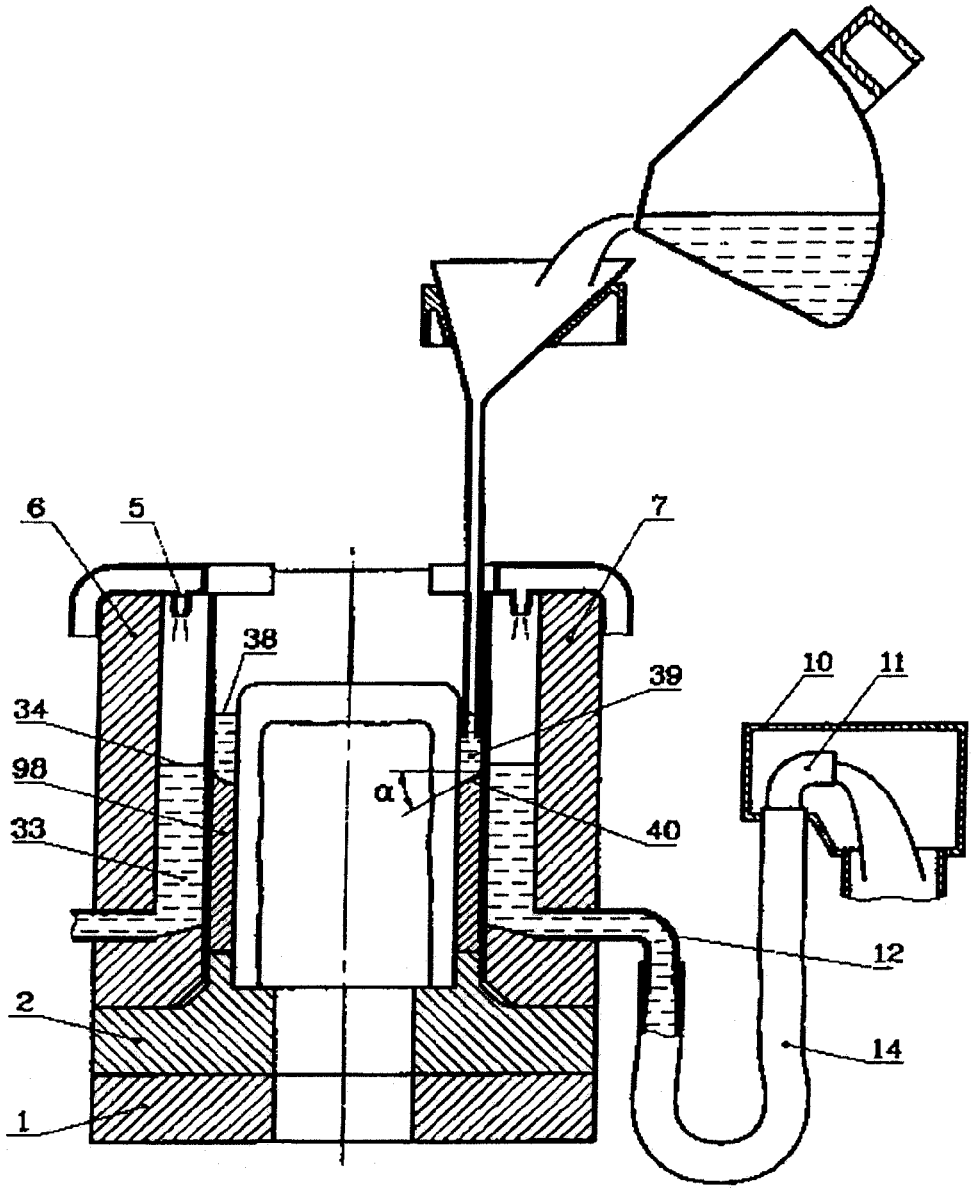
FIG. 10 is a schematic view of the process of crystallization of the typical bottom tubular casting.
Figure 20:
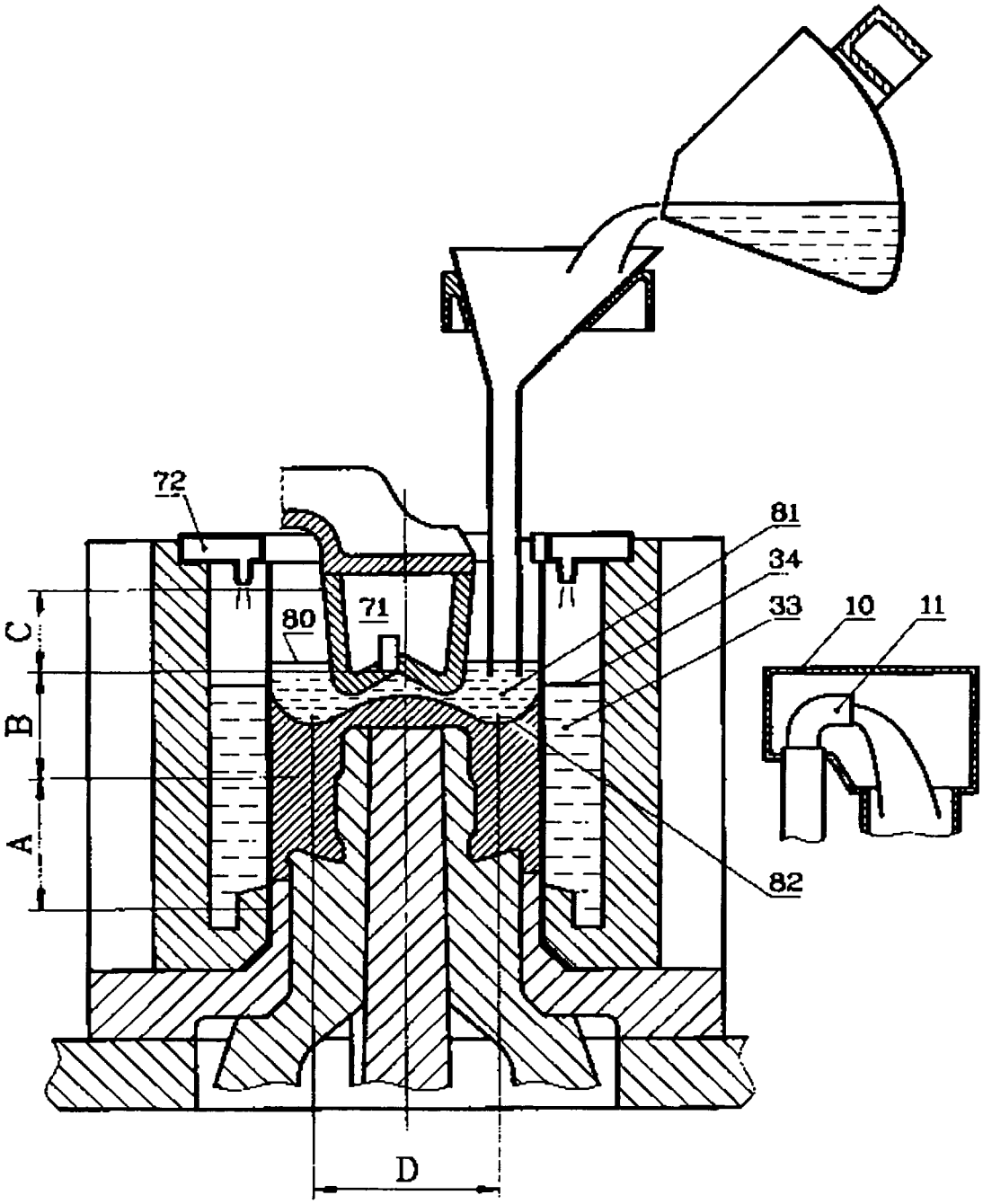
FIG. 20 is a schematic view of crystallization state of the section B of the aluminum piston in the preferred embodiment of the present invention.

As shown in FIGS. 9, 10 and 20, the technical process for carrying out the present invention must relay on a pre-state, which is that the melting stock 36, 39 and 81 poured into the mould cavity is above the liquid phase point temperature for a sufficient period of time, that is, before rapid, sequential thermal diffusion reaches a position, the melting stock of the position is not allowed to crystallize. This pre-state may be further described as the following: the melting stock, casting mould, tool-setting-up outside mould and atmosphere are deemed to be a system. After the melting stock is poured into the mould cavity, only small amount of heat is allowed to transfer within the system. The transfer of this small amount of heat is not sufficient to cause the melting stock 36, 39 and 81 in the mould cavity or melting stock 36, 39 and 81 in a part of the mould cavity to crystallize, and the melting stock is kept above the liquid phase point temperature for a sufficient period of time. This pre-state is crucial to the technical process of the present invention. Only in this pre-state can cooling medium 33 push crystallization interface 37, 40, 44, 78 and 82 to move from bottom to top. It is exactly the crystallizer of the present invention, which has this pre-state. The mass heat capacity of semi-film mould 8 and 9 is very small, in the process that the system tends to be heat balance, the heat absorbed by the film mould from 25° C. towards 700° C. can only lower the temperature of 10 mm-thick melt aluminum by about 41~43° C.; The fringe 21 of the position-limiting part is pointed and thin, so it has an extremely small heat transfer area, and the heat that is transferred to the mould seat before the cooling medium is poured is not sufficient to change the pre-state.

Embodiment 1

The first embodiment of the present invention is as shown in FIGS. 1 and 2. The crystallizer is used to cast the tubular casting 97 in FIG. 22. The tubular casting is an aluminum-based bearing alloy, with an outer diameter of 414 mm.

As shown in FIGS. 1 and 2, the crystallizer comprises such parts as the base 1, end mould 2, medium channel bottom passage 3, sand core 4, medium-supplying port 5, mould seats 6 and 7, film moulds 8 and 9, liquid level controller 10, medium-discharging port 11, drain pipe 12, soft pipe 14, and position-limiting part 16.

straightedge position-limiting part 16 and mould seats 6 and 7 are cast as an integrated body, and the materials used are nodular graphite cast iron. If the section of the tubular casting is used as the projection plane, the projection of the position-limiting part is arranged in a radiated form, with the source of radiation being on the circular center of the tubular casting, or in other place if necessary. The inner side of the position-limiting part is a shaped fringe 21, whose sectional shape is triangle with the top truncated by cylinder 22, the length of truncate arc is 0.5~6 mm. The arc of the two adjacent fringes truncated by cylinder 22 is 2~50 mm long. In this embodiment, the arc is 1.6 mm long, and the arc on cylinder 22 between the two adjacent fringes is 32.6 mm, which is equivalent to that the angle between the two adjacent position-limiting part is 9°. The virtual cylinder 22 shown with the double dotted line is the cutting trace of the tool in the course of implementation; hence the truncate arc of the fringe 21 and the inner bottom of the mould seat 25 are cut out of the same mass. Between the adjacent position-limiting parts is a vertical gap, i.e. slot 17-1, and on the upper end of each slot there is medium-supplying port 5. At the bottom parts of all the slots on the same mould seat are communicated with the passage 3, and communicated with the drain pipe 12. On each mould seat there are at least two mould closing fits 57 and 59. On the mould closing fits are a plurality of inserting slots 23.

As shown in FIGS. 5 and 6, the film moulds 8 and 9 have the mould walls 8-1 and 9-1. The arc of the mould wall is as precisely as 0.0005 long. The mould wall is 0.8 mm thick. The ratio of the thickness of the film mould and the diameter of the tubular casting is normally between 0.002~0.006. In practical, if the calculated mould wall thickness of film mould is not standard data, it can be estimated to the standard thickness. In this embodiment, the thickness of the mould wall is 0.8 mm. Each film mould has at least two mould ears 8-2, 8-3, 9-2, and 9-3, which are formed by the mould walls stretching 90 mm along the mould joint. On each of the mould ears there are three pins 8-4 and 9-4.

As shown in FIG. 7, the end mould 2 has upper part 26. According to formula I, the diameter of the upper part is (414-0.8=413.2) mm.

Before moulds being closed, it is necessary to attach the film mould to the mould seat, by plugging the pins into the inserting slots. This attachment is a loose connection only to ensure that the film mould is not detached from the mould seat after the mould opens, because it needs a small space for free movement before being accurately located. After moulds being closed, the film mould is imbedded in the space made available by accurate fit among upper part 26, inner bottom of the mould seat 25, mould closing fits 53, 55, 57 and 59, and position-limiting part 16.

As shown in FIG. 2, before the position of the film mould is compulsorily determined, the mould wall of the film mould must have a precise arc length, without the need to pay attention to its circularity. When the mould seats 6 and 7, under a mechanic effect, come close along the direction of F1 and F2 and are flexibly press each other, they tightly press the four mould ears 8-2, 8-3, 9-2 and 9-3 of the two film moulds between two pair of mould closing fits, the mould walls 8-1 and 9-1 produce tension, the tension of the mould walls and the anti-tension of position-limiting part 16 form a pair of force couple for accurate positioning, and to achieve rigidity, of the mould walls.

As shown in FIGS. 1 and 2, after the mould walls is positioned, the mould walls 8-1 and 9-1, a plurality of position-limiting parts 16, inner bottom of the mould seat 25, the mould closing fits 53, 55, 57 and 59, drain pipe 12 jointly form the leakage-free cooling medium passageway, i.e. cooling medium channel 17. The lower end of the medium channel is serially communicated to the drain pipe, soft pipe and medium-discharging port, and then form a connector; the cooling medium in the medium channel circulates in such a direction that water is supplied from the upper end and discharged from the lower end. It must be explained that the diameter of the drain pipe 12, soft pipe 14 and medium-discharging port 11 should be large enough to make the amount of discharged water larger than that of the supplied water. The discharge diameter in this embodiment is 1.25 in. If the 20 mm liquid lever difference is kept for the cooling medium at the two ends of the loop circuit, the maximum water discharge is 0.025 $m^3$/min, while the maximum amount of water supply is 0.016 $m^3$/min. Medium-discharging port 11 is fixed in liquid level controller 10 within the vertical travel which is lower than the lower end and higher than the upper end of the medium channel. The liquid level controller 10 may take the medium-discharging port 11 to stop at any height or ascend or descend at any speed. The ascending and descending of the liquid level controller is mechanically driven.

If the medium-supplying port 5 keeps on pouring the cooling medium 33 into the medium channel 17, according to the principle of the connector, the cooling medium liquid level 34 in the medium channel and the medium-discharging port 11 are always on the same water level. When liquid level controller 10 takes the medium-discharging port 11 to ascends and descends, the cooling medium liquid level 34 in the medium channel moves synchronically with the medium-discharging port. In this embodiment, the liquid level controller is mechanically driven. Therefore, the height and speed of movement of cooling medium liquid level 34 in the medium channel are precisely controlled by command.

Figure 8:
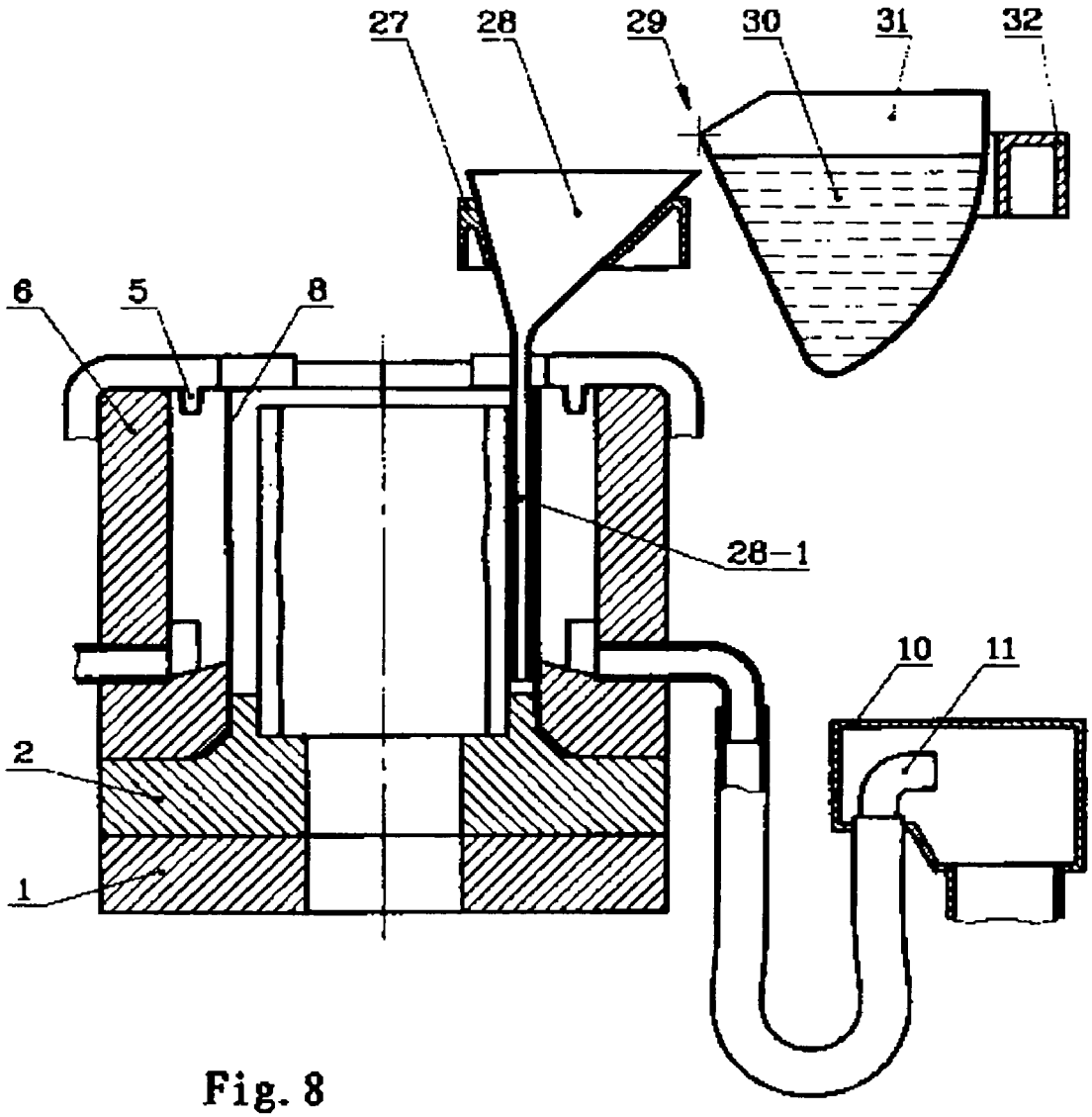
FIG. 8 is a schematic view of the pre-casting state of the crystallizer of the present invention, at this time the pouring pipe of the pouring cup has stretched to the bottom part of the mould cavity.

As shown in FIG. 8, in the relative position over the crystallizer are the pouring cup 28 and the pouring ladle 31, which respectively have their operating mechanism 27 or 32. The pouring cup 28 and pouring ladle 31 form fixed pouring location through their respective operating mechanism; when ascending and descending, the pouring ladle 31 can also inverse with the invert center 29 as the axis. The invert center is arranged at a place where it enables melting stock to form the flow on a slope after pouring melting stock into the pouring cup 28.

For the convenience of calculating the pouring velocity, the radial sectional shape of the pouring ladle 31 is designed into a sector to take the invert center as the circle center. Each degree the pouring ladle inverses, the poured melting stock is of a fixed amount. The speed at which the pouring cup and pouring ladle ascends and descends and the speed at which pouring ladle tilts and inverts are both under the parameter control. The pouring cup 28 and pouring ladle 31 are made of austenitic steel. Depending on the section shape of the mould cavity into which the pouring cup 28 enters, the section of the pouring cup 28 may be round, square, or of a special shape. The wall of the pouring ladle 31 is 1 mm thick, that of the pouring cup is 0.6 mm thick, with a casting paint spayed on their surface. In the entire course of pouring melting stock in the mould cavity, the relative position between the pouring cup 28 and pouring ladle 31 remain constant.

The crystallizer having the above features is the basic crystallizer of the present invention, capable of rapid, sequential and bottom-top thermal diffusion of the typical tubular casting, such as the bottomless tubular casting 97 and the bottom tubular casting 98.

Embodiment 2

Figure 24:
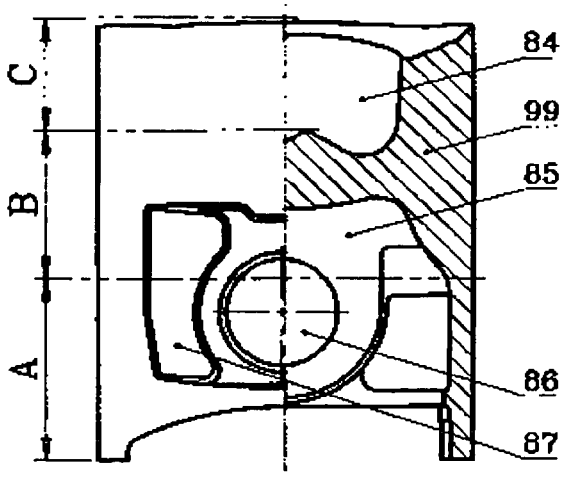
FIG. 24 is a section view of special-shaped tubular casting in the preferred embodiment of the present invention; and the casting is billet of aluminum piston (Φ110)
Figure 25:
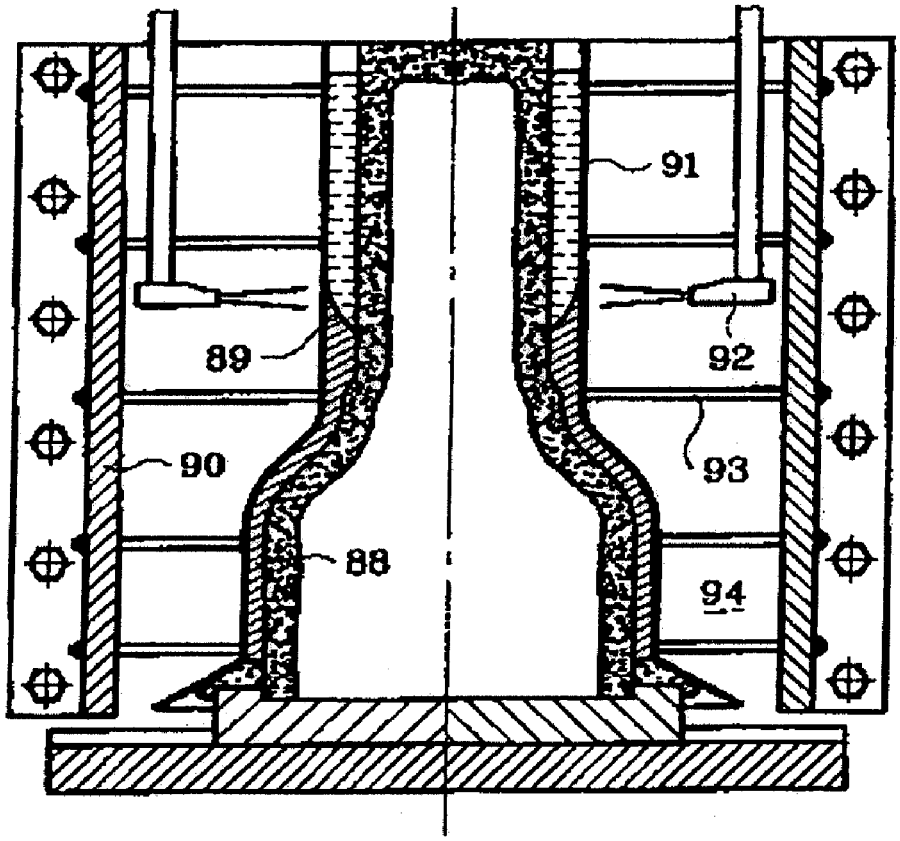
Fig. 25 (Prior Art)
FIG. 25 is a schematic section view of film mould crystallization of the prior art.

As shown in the FIG. 24, there are continuous or discontinuous variations in its sectional shape of the bottomless tubular casting 99. This tubular casting is regarded as special-shaped tubular casting. Casting special-shaped tubular casting 99 requires that the crystallizer and casting method of the present invention have more features. This embodiment will take the casting 99 as an example to explain the crystallizer and casting method of the special-shaped casting.

As shown in FIG. 24, a crystallizer for casting special-shaped tubular casting is called a special-shaped crystallizer. The special-shaped tubular casting 99 is an internal combustion engine piston. Pinhole 86 and concave surface 87 need to be cast in casting 99. For this purpose, the present invention has designed the level tetrad segregation type of crystallizer.

Figure 12:
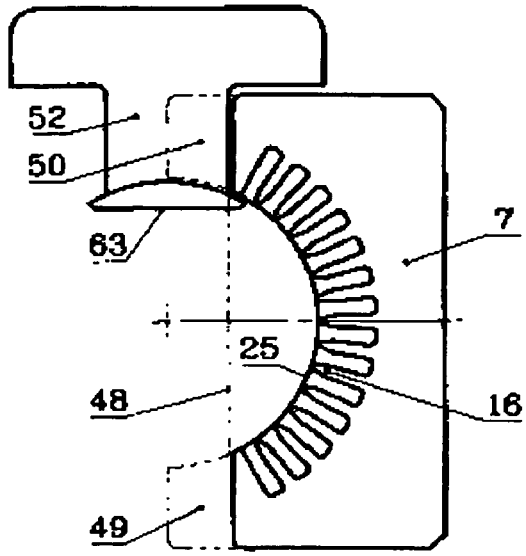
FIG. 12 is a schematic structure view of the special-shaped crystallizer of the present invention, with a metal mould being added.
Figure 13:
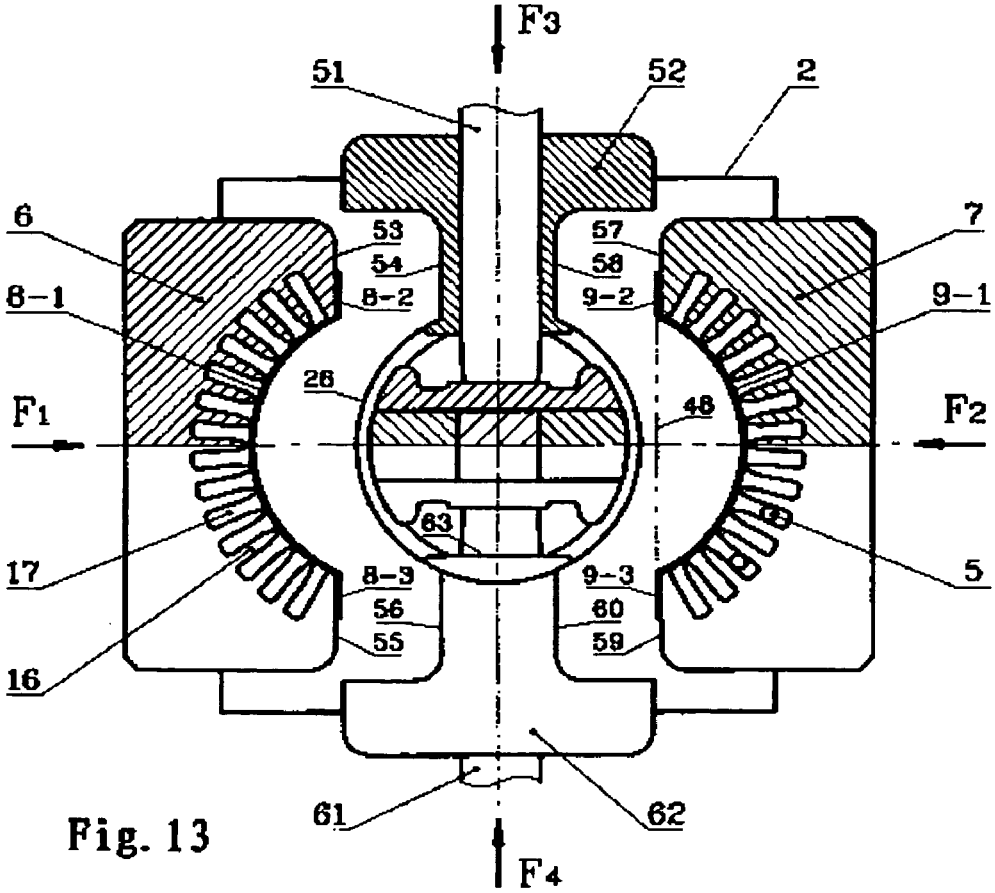
FIG. 13 is a schematic view of inter-relation of the parts of the special-shaped crystallizer before closing mould.
Figure 14:
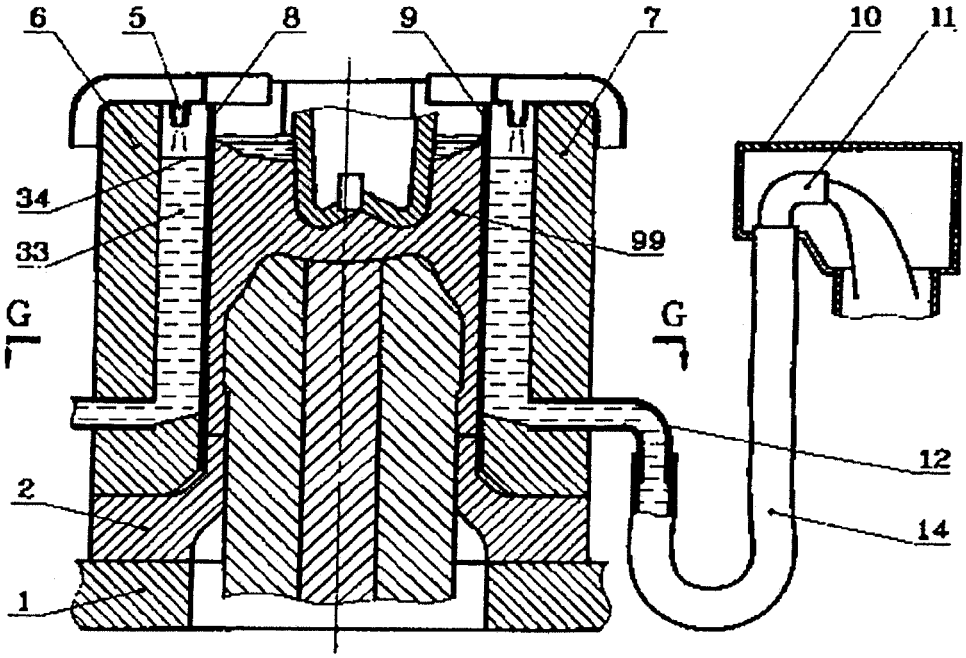
FIG. 14 is a schematic view of the working condition of the special-shaped crystallizer of the present invention.

As shown in FIGS. 12 and 13, on the basis of the basic crystallizer, each mould seat is cut away two zones 49 and 50. To the cut zone is added metal moulds 52 and 62; after cutting away two zones 49 and 50, a new mould joint 48 forms. The mould ears 8-2, 8-3, 9-2 and 9-3 should be formed by mould wall 8-1 and 9-1 extending a width on the mould joint 48. The basic mould cavity surface in the inner side of the metal mould remains consistence with the cylinder 22. On the basic mould cavity surface in the inner side of the metal mould, a platform 63 comes into being, which is the mould cavity surface in which pinhole convex surface 87 is cast.

If any special-shaped structure is formed on the periphery of the tubular casting, one or more metal moulds are also added to make up for the mould cavity surface that the film mould cannot form. The metal mould and film mould combine with each other, in a ring-shaped structure, to jointly form the periphery of the special-shaped tubular casting. Each metal mould has at least two sides, 54, 58, 56 and 60, used as mould closing surfaces.

Each metal mould contains a pinhole core bar 51 or 61, which can be pulled or pushed within the pinhole core bar for easy placement and de-moulding.

As shown in FIG. 13, a ram 75 brings the metal moulds 52 and 62 move forward in the direction of F3 and F4 until they solidly touch and tightly press upper part 26, then the mould seats 6 and 7 bring the film moulds 8 and 9 to come close along the direction of F1 and F2, and are softly press each other, and respectively press mould ear 8-2 between the mould closing fits 53 and 54; press the mould ear 8-3 between the mould closing fits 55 and 56; press the mould ear 9-2 between the mould closing fits 57 and 58; press the mould ear 9-3 between the mould closing fits 59 and 60. A lower section of mould walls 8-1 and 9-1 are tightly pressed in between the inner bottom of the mould seat 25 and the upper part 26. According to the above-said principle, the tension of the mould walls and the anti-tension of the position-limiting part form a pair of force couple to accurately determine the position of the film mould, and to achieve rigidity, of film mould walls 8-1 and 9-1.

Figure 16:
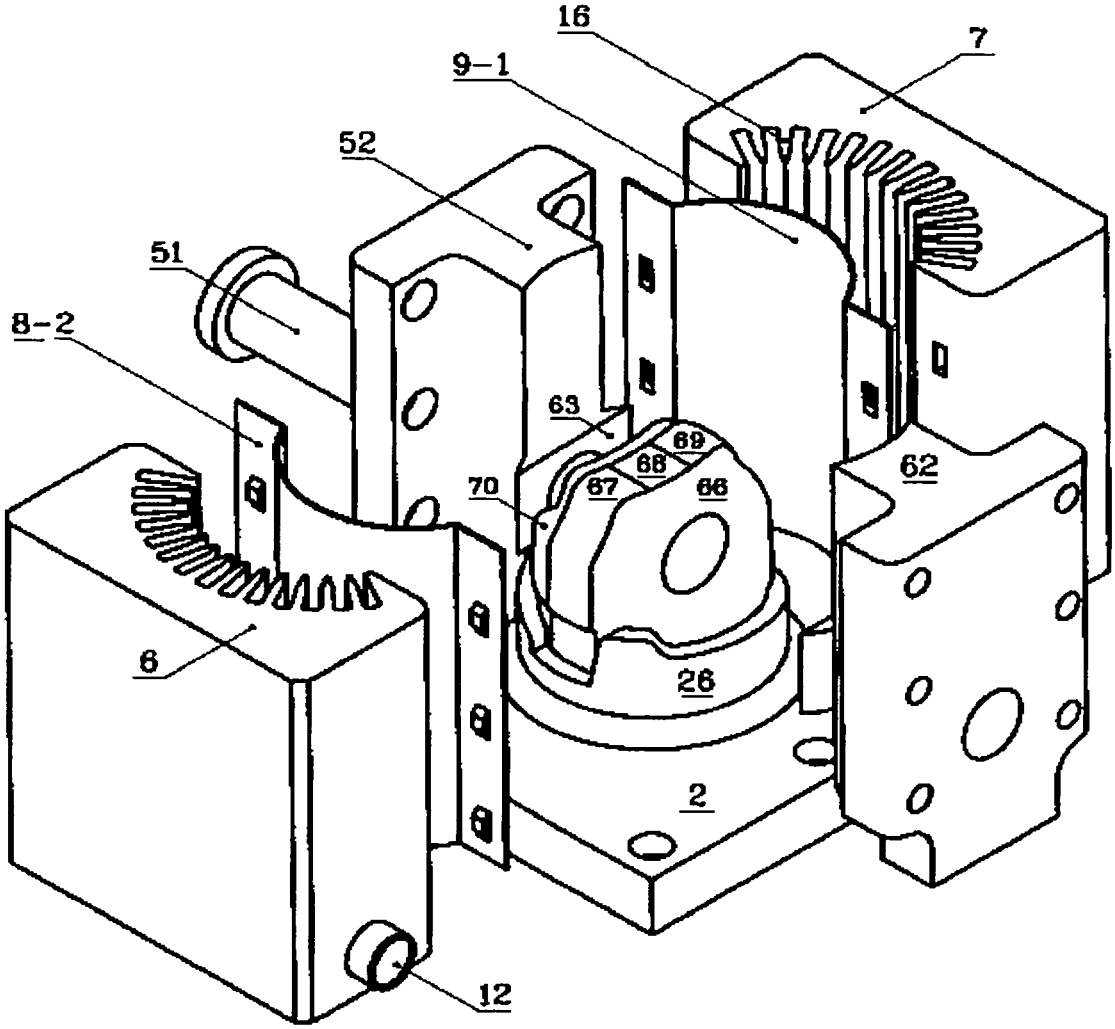
FIG. 16 is a perspective view of the special-shaped crystallizer of the present invention before closing mould.

As shown in FIG. 16, an inner cavity 85 needs to be cast on the casting 99, and metal mould cores 66-70 stretch upward from the lower part of the end mould 2.

Figure 17:
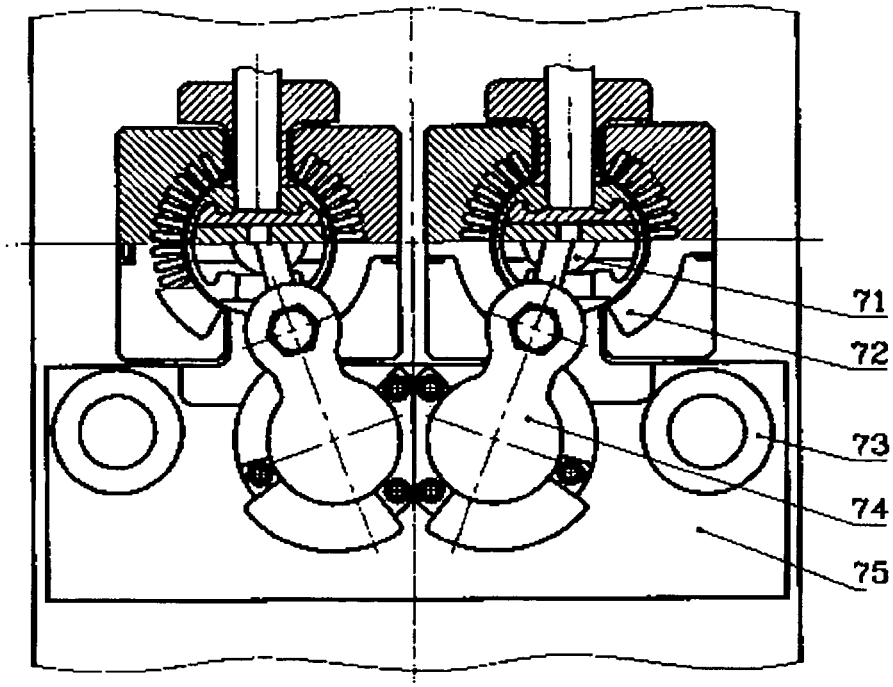
FIG. 17 is a schematic view of the mould-closing state of the special-shaped crystallizer of the present invention.

As shown in FIG. 17, water is uniformly supplied to a plurality of medium-supplying ports S on the same mould seat by a water distribution box 72. The water distribution box has four functions, i.e., supplying water, adjusting the flow of the water supply, instantly cutting off the water supply, and changing the positive pressure inside the water distribution box into negative pressure and sucking away all the remaining water in the water distribution box.

Figure 18:
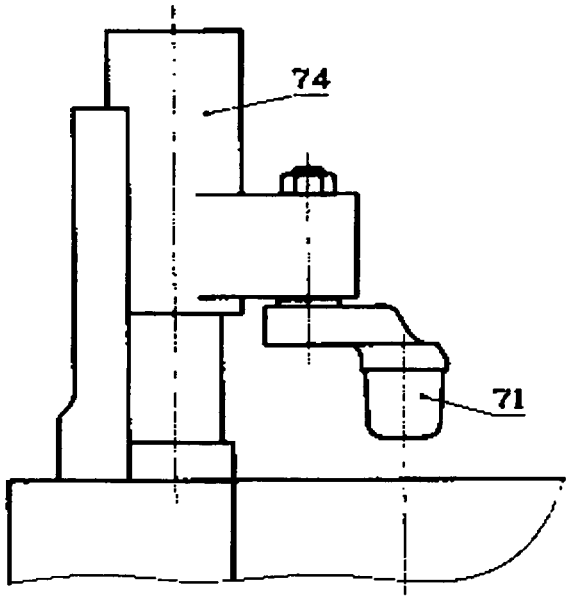
FIG. 18 is a side view of the top core and the top core operating mechanism in the preferred embodiment of the present invention.

As shown in FIGS. 17, 18 and 24, a firing chamber 84 needs to be cast on the casting 99. On top of the mould cavity are installed the top core 71 and the top core operating mechanism 74. The top core 71 is made of non-metal material or composite material, preferably of silicon nitride ($SiN_2$). Close to the top core is arranged a heater 73. The top core moves to and fro according to the casting cycle between the mould cavity and heater. The top core's to-and-fro movement is automatically done under the joint effect of the top core operating mechanism 74 and the program control. To satisfy the pre-state, the top core is first detached from its core, and then ascends after one cycle of the casting, and then rotates in alignment with the heater, and then descends into the heater. Except in the time of casting, the top core always stays inside the heater to keep its temperature.

The end mould 2 and metal moulds 52 and 62 are made of hot die steel. 3Cr2W8V is used in this embodiment, film moulds 8 and 9 are made by cold pressing of martensite heat resistant steel sheet. For this embodiment, 2Cr13 or 1Cr17Ni2 is used for the film mould. The wall of the film mould is 0.4 mm thick. The pouring cup 28 and pouring ladle 31 are made of austenite heat resistant steel. For this embodiment, 1Cr18Ni9Ti is used to make them. The wall of the pouring cup is 0.6 mm thick, and that of the pouring ladle is 1 mm thick.

The crystallizer may be single or multiple casting positions. As shown in FIG. 17, a double-casting-position crystallizer is designed for this embodiment. It should be noted that the fit surface of the parts of the crystallizer used in the present invention must be of certain accuracy, as described below:

The inner bottom of the mould seat 25 and cylinder 22 are processed to have accuracy grade 6-7 according to China Standards; the mould closing fits 53, 55, 57 and 59 of the mould seat, and metal mould sides 54, 58, 56 and 60 are processed to have accuracy grade 5-6 according to China Standards; and the stamping die of the film mould is made to have accuracy grade S according to China Standard.

As shown in FIG. 24, the special-shaped tubular casting 99 is divided into sections along the axis on the basis that those with identical or similar sectional shape are put in one section. Thus, after the thermal balance conditions (e.g. melting stock, cooling medium, film mould, fringe top truncate arc length, mould core, etc.) in the system are determined, the fastest velocity of crystallization of the casting sections becomes a given amount, known as "finite element velocity", with "R" used to indicate its value. The formula hitherto used to calculate value R of the "finite element velocity" has been worked out according to the existing hardening theory and method for calculating heat transmission. The feature of the present invention is inputting value R, as the velocity of movement of the cooling medium liquid level 34, into the control system of the liquid level controller 10. If a section along the axis of a casting is an all thin-walled structure (section A in FIG. 24), its value R tends to be infinite. When setting the casting velocity and the cooling medium liquid level ascending speed of the section, a large value may be taken. As a result, the casting of this section hardens in way of rapid volume crystallization. The rapid volume crystallization may also obtain fine material structure.

In the course of carrying out the present invention, the following key points and flowchart of the technical process are the general principles that must be complied with in all the embodiments.

Figure 15:
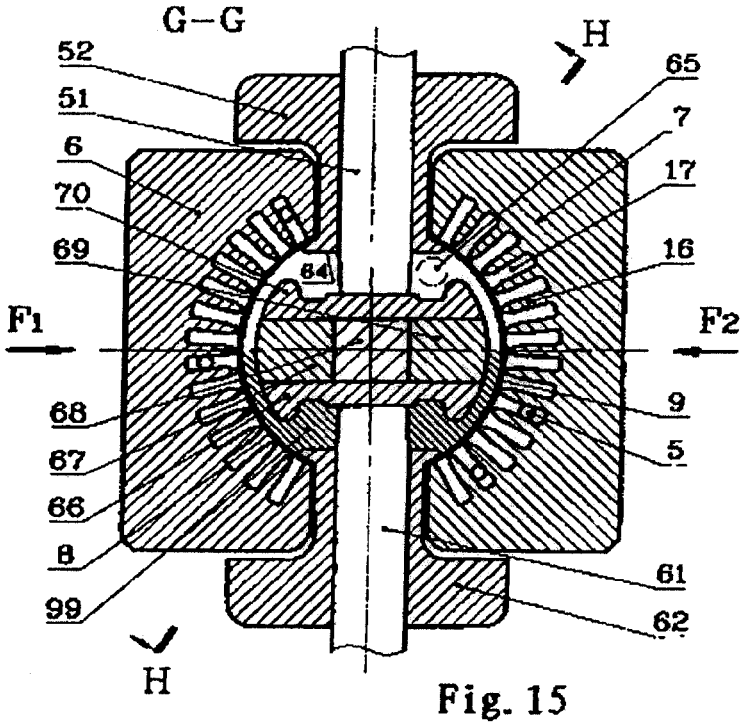
FIG. 15 is a section view along line G-G in FIG. 14.
Figure 19:
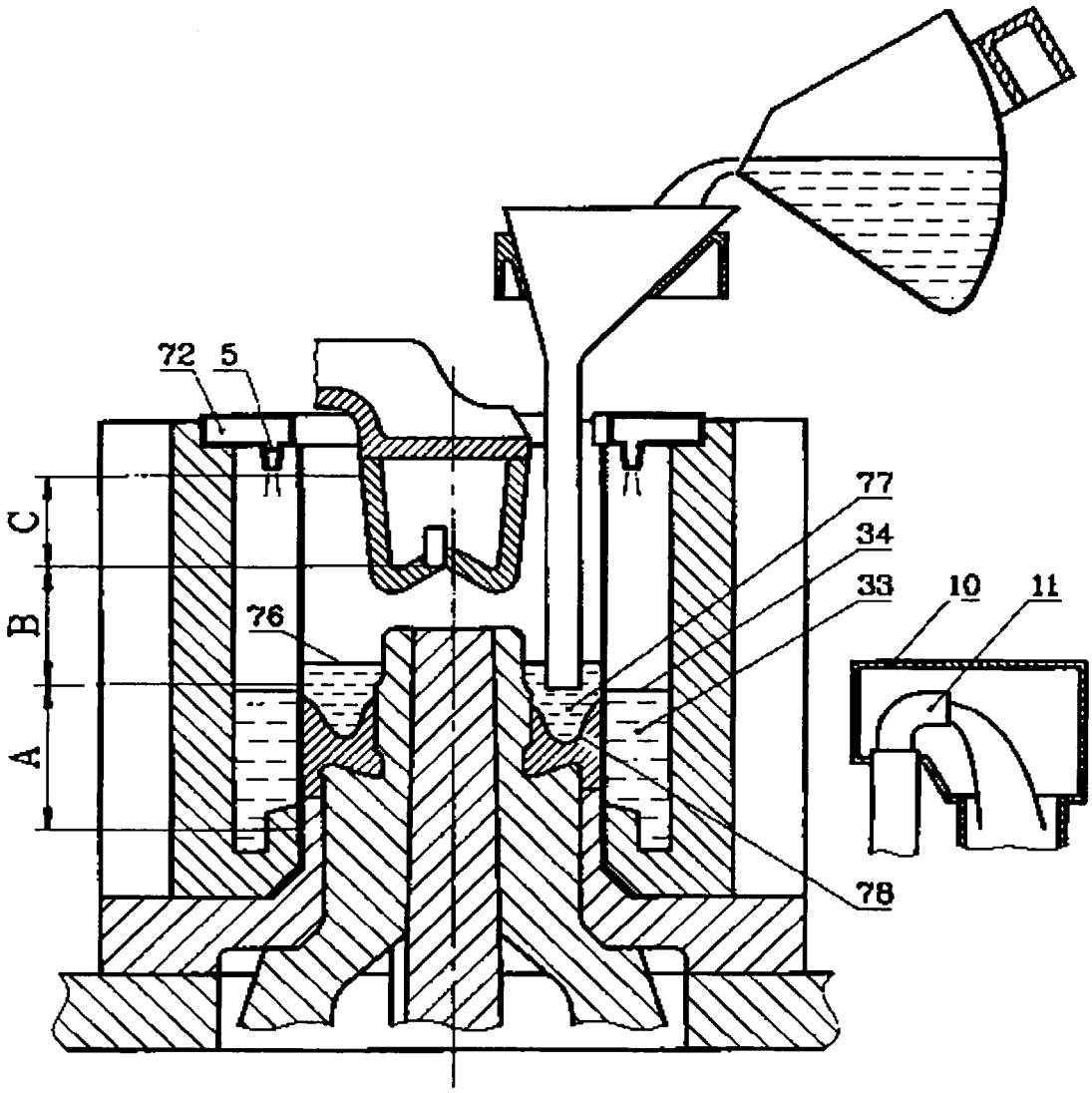
FIG. 19 is a schematic view of crystallization state of the section A of the aluminum piston in the preferred embodiment of the present invention.

As shown in FIGS. 15 and 19, a pouring pipe 28-1 of the pouring cup stretches to the bottom part of the mould cavity in the position 65 (referring to FIG. 15) the mould cavity allows it to pass. At the beginning of pouring, the pouring cup remains still, and pouring ladle inverts. When liquid level 76 of the melting stock 77 in the mould cavity submerges the bottom end of the pouring pipe for 10~30 mm, the pouring cup and pouring ladle ascend synchronously at the same speed as that at which the melt level ascends. Before all the melting stock of one cycle is used up, the bottom end of the pouring pipe remains at 10~30 mm below the melting stock liquid level.

As shown in FIGS. 8 and 19, the melting stock 30 is poured into the mould cavity before the cooling medium 33 is poured into the medium channel. The two steps should not be taken at the same time, nor the latter is done before the former for these reasons. First, when poured into the medium channel, the medium (e.g. water) exists in five ways: gravity water, capillary water, film water, suction water, and crystal water (in the casting paint). The suction water and crystal water will not cause burst of evaporation in the temperature below 900° C., gravity water cannot enter the mould cavity through the tiny gap between the film mould, inner bottom of the mould seat and mould closing fits, and only the capillary water and film water slowly spread towards the mould cavity along the film mould. If the melting stock 30 is poured into the mould cavity before the cooling medium 33 is poured into the medium channel, and causes the temperature of the film mould to be higher than 150° C., the capillary and film water will evaporate, under this temperature condition, at a speed higher than its spreading speed to avoid their entering the mould cavity, so as to prevent the burst of evaporation from taking place inside the mould cavity. Second, when R is more than 25 mm/s, if the melting stock 30 is poured into the mould cavity after the cooling medium 33 is poured into the medium channel, it will cause the temperature of the melting stock first poured into the mould cavity drop sharply to form cold shut or cold hole (also referring to as dormer window).

As shown in FIGS. 9, 10 and 20, the melting stock liquid levels 35, 38 and 80 inside the mould cavity must be higher than the cooling medium liquid level 34. To set this level height difference in the technical process is to form the pre-state: before the rapid and sequent thermal diffusion involves a particular position, the melting stock 36, 39 and 81 in that position are not allowed to crystallize. It is not necessary to strictly control the level height difference value. It will do as long as the pre-state is satisfied.

As shown in FIG. 20, to fulfill the pre-state requirement, the temperature of the top core 71 is always kept above the liquid phase point temperature of the casting metal.

The technical process of the present invention does not remove the strong thermal absorption function of non-cooling medium at the bottom or at a given height of the bottom of the mould cavity because the strong thermal absorption function of non-cooling medium at the bottom or at a given height of the bottom of the mould cavity does not go against the bottom-top directionality and physical property of thermal conductivity of the rapid thermal diffusion. Quite the contrary, the technical process of the present invention guide strong thermal absorption function of non-cooling medium at the bottom or at a given height of the bottom of the mould cavity to become a part of the rapid, bottom-top, sequential thermal diffusion. Crystallization interfaces 78 and 82 in FIGS. 19 and 20 are jointly formed by virtue of the strong thermal absorption function of the cooling medium and metal mould core. A part of crystallization interface indicated as "D" is formed by the thermal absorption function of the top part of the metal mould core. Since the temperature gradient between the metal mould core and the melting stock is lower than that between the cooling medium and the melting stock, the vertical progression speed of crystallization interface D is relatively slow. Then, it is necessary to slow down the ascending speed of the liquid level of cooling medium or make it stand still. To sum up, when casting complicated tubular casting, in the presence of the strong thermal absorption of non-cooling medium at the bottom or at a given height of the bottom of the mould cavity, adjust the speed of movement of the liquid level of the cooling medium to quicken it or slow it down, and make the strong thermal absorption of cooling medium and the strong thermal absorption of non-cooling medium cooperate to work so as to form the constant and smooth crystallization interface rapidly pushed from bottom to top.

As shown in FIG. 15, as mentioned above, the strong thermal absorption function of non-cooling medium at the bottom or at a given height of the bottom of the mould cavity is a part of the rapid, bottom-top, sequential thermal diffusion; hence, the technical process of the present invention controls the temperature of the mould cores 66-70 at the bottom of the mould cavity and the end mould 2 at a low level, and the average temperature of the various parts of mould cores and end mould is kept under 170° C., with the surface instant temperature not exceeding 320° C. By contrast, that of top core 71 is kept above the liquid phase point temperature of the casting alloy.

Figure 21:
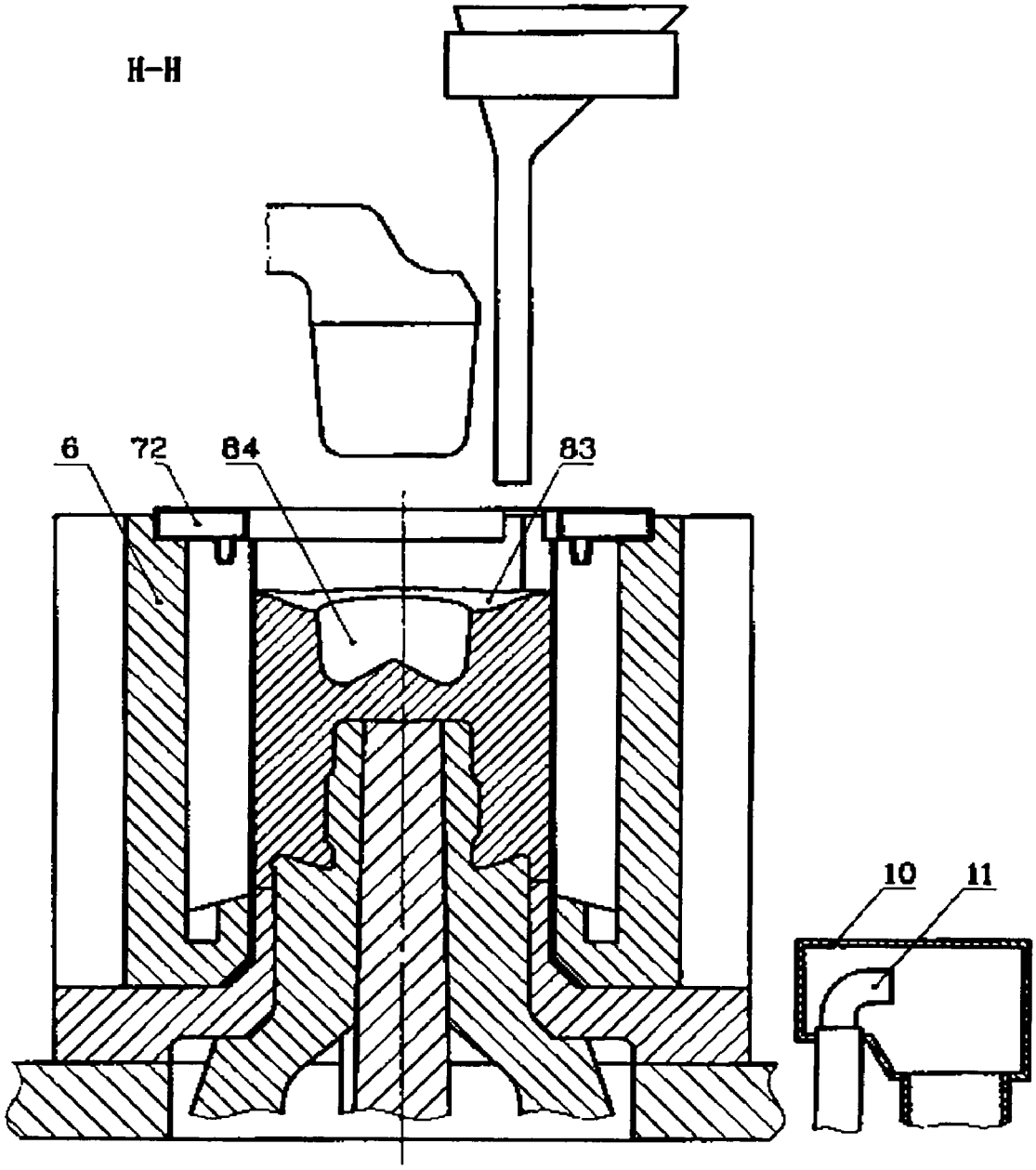
FIG. 21 is a schematic state view of the air-cooling time period after crystallization of aluminum piston in the preferred embodiment of the present invention.
Figure 22:
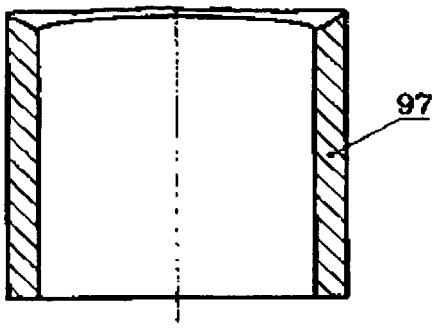
FIG. 22 is a section view of the bottomless tubular casting in the preferred embodiment of the present invention.
Figure 23:
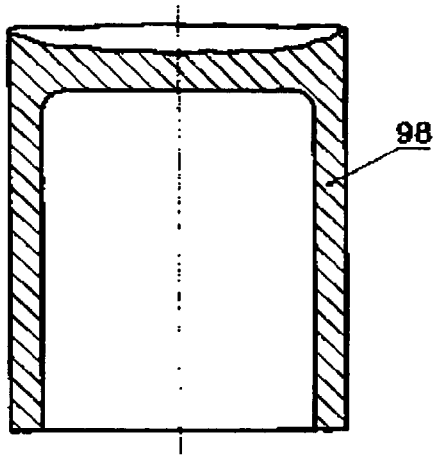
FIG. 23 is a section view of the bottom tubular casting in the preferred embodiment of the present invention.

As shown in FIG. 21, after the casting finishes crystallization, the water distribution box 72 cuts off the water flow, and sucks away the remaining water. The liquid level controller descends to the lowest position. A air-cooling period continues after exhausting all cooling medium from the medium channel. The air-cooling period for a large or medium-sized tubular casting is somewhere between 10~90 seconds. The purpose to set the air-cooling period is to dry, with the remaining heat of the casting, the capillary water and film water on the back face of the film moulds 8 and 9, and on the surface of the inner bottom of the mould seat 25 and the mould closing fits 53, 55, 57 and 57 to prevent it from spreading on the inner wall of the film mould between two casting cycles.

Figure 11:
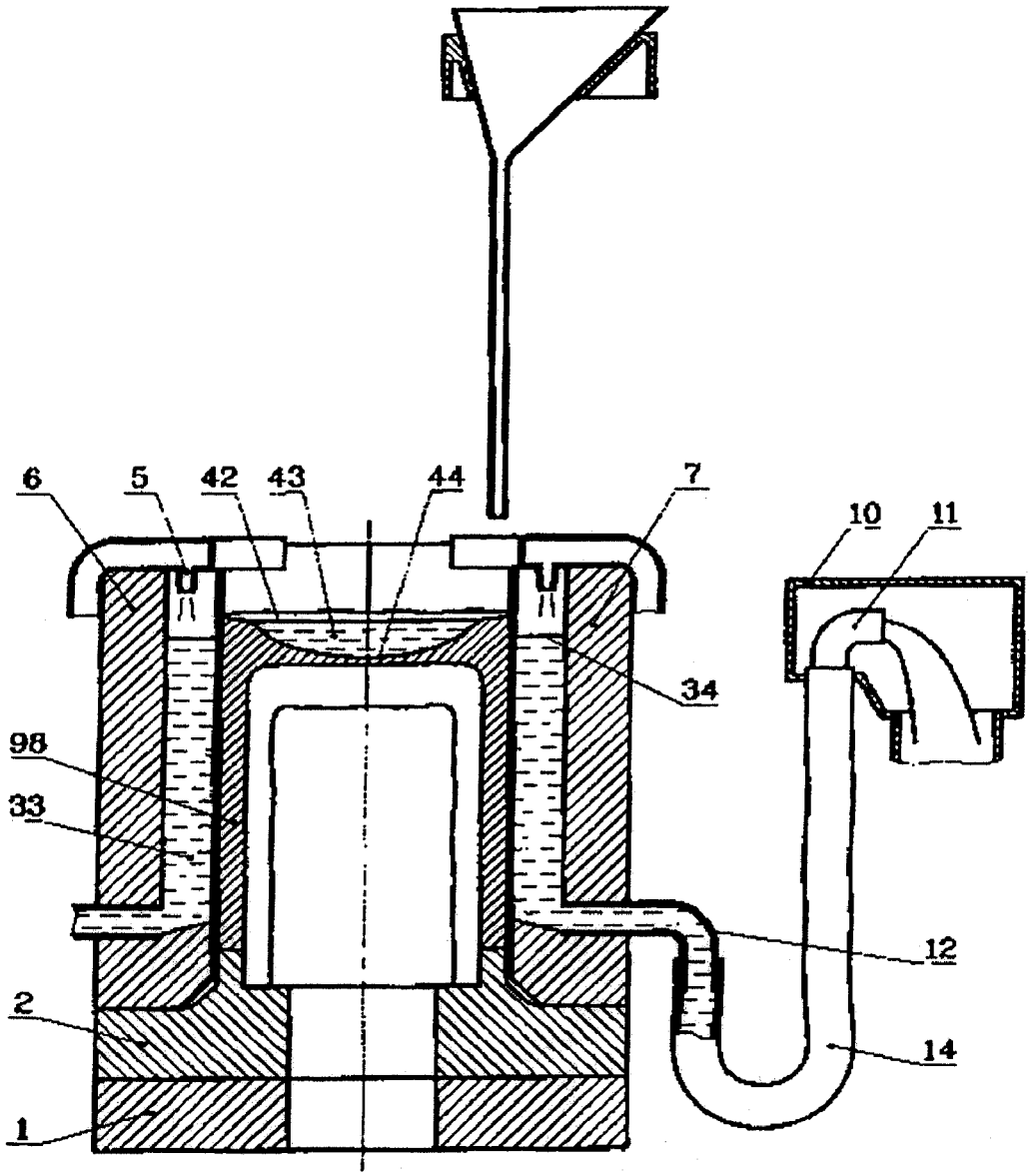
FIG. 11 is a schematic view of the necked-in treatment of liquid depression when the casting crystallization enters the final stage.

As shown in FIGS. 11 and 21, due to the bottom-top, sequential crystallization, the final liquid depression 43 or shrinkage depression 83 of casting exists in its topmost part. The depth of the resulting liquid depression has direct effect on the yield of cast metal. The technical process of the present invention provides the final liquid depression a necked-in treatment, whereby value R is set at a small value to guide the crystallization interface 44 to moderate its slop, that is, guide angle $\alpha$ to go towards small variation. If necessary, value R may be zero or a negative number. The necked-in treatment is necessary only when a large area of exposed liquid level 42 exists on top of the casting.

The flowchart of the technical process: mould closing—the pouring cup pouring pipe stretches to the bottom of the mould cavity, the pouring ladle contains melting stock in place and forms casting combination with the pouring cup—pouring begins—after aluminum liquid level in the mould cavity submerges the pouring cup in 10~30 mm, the pouring ladle and pouring cup ascend synchronously—the water distribution box supplies cooling water, which enters the medium channel—the liquid level controller ascends according to the finite-element velocity of each section—crystallization ends—the water distribution box stops supplying water, and sucks away the remaining water in the water distribution box—the liquid level controller descends to the lowest point, and discharge the remaining water in the medium channel—continue the air-cooling time period—lift the mould and demould.

Referring to FIGS. 19-21 and 24, in line with the structural characteristics of the aluminum piston 99, use formula II to calculate value R of the place where changes take place in the section shape of aluminum piston, and divide the piston into three sections A, B and C along its axis through grouping and sorting.

Section A is in its skirt section. It is entirely of a thin wall structure. The thermal capacity of melting stock is small. Besides, it has the metal mould core in itself, end mould in the lower part, and cooling medium outside it, strong thermal absorbing medium on three sides. Controllable condition for thermal diffusion does not exist at all. That is, the pre-state is absent. Besides, under the strong thermal absorption effect, the thin-wall structure rapidly crystallizes in volume, without the need for additional shrinkage passage; hence, the mould should rapidly fill in section A. The melting stock liquid level ascends to the peak of section A at a speed of 30~40 mm/s, and the cooling water liquid level does so at the same speed one second later.

Section B is at a position above the skirt section of the piston and below the firing chamber. The section of this section is in a shape of bridge arc. Then the strong thermal absorption of the metal mould core is harmless. Instead, use should be made of it to form a hill-shaped crystallization interface 82, which is formed under the strong thermal absorption effect of the cooling medium and metal mould core. At this time, the hill-shaped crystallization interface 82 should not be too steep. Angle $\alpha$ is at the value 35~45°. If it is too steep, this shape will continue up to the shrinkage depression 83 on top of the piston, which would render the necked-in treatment difficult, and the shrinkage depression too deep, increase the cutting volume of the top shrink head, and seriously affect the rate of metal usability. To form a relatively smooth slope for the hill-shaped crystallization interface, when the melting stock liquid level submerges the metal mould core, the pouring rate immediately slows down to await the thermal absorbing process on the mould core top surface. Meanwhile, the cooling medium liquid level 34 stops at a slightly higher position of the mould core interface to await the formation of the hill-shaped crystallization interface 82. The value R at this time is actually the speed of the vertical progression of the hill-shaped crystallization interface, the corresponding $G_{TS}$ shows the temperature gradient of the solid phase vertical unit length in the upper part of the metal mould core, and $G_{TL}$ shows the temperature gradient of the liquid phase vertical unit length in the upper part of the metal mould core. The obtained value R is at 3~4 mm/s. The cooling medium liquid level continues to rise to enter section C after it stops for 6~7 seconds.

After entering section C, since the temperature of upper core itself is higher than or equal to that of the liquid phase point of melting stock, the thermal diffusion condition of the melting stock is suddenly simplified to a single element, which is fully controlled by the cooling medium. Therefore, the casting velocity of section C is in wide in scope, and may not be associated with the speed at which the cooling medium liquid level ascends. The whole section is cast generally at 10~15 mm/s. The speed at which the cooling medium liquid level ascends should not be arbitrary, but moves at value R, which is at 7~9 mm/s.

When crystallization interface approaches the top end of the casting, the cooling medium liquid level stops on the height of the crystallization interface, the final liquid depression is formed in necked-in treatment.

The air-cooling time period in this embodiment is 12~15 seconds.

In the present invention, The adopted quantity and shape of the mould seat and film mould may be determined according to the actual requests of casting. For the bigger casting, a plurality of mould seats and film moulds may be combined together; for the casting of complicated shape, the shape of mould seats and film moulds have corresponding shapes, as long as the mould cavity required by the casting may be formed after the mould seats and film moulds close together. Here there is no limitations.

Here, the description and application of the present invention are explanatory, and are not meant to limit the scope of the present invention to the above-discussed embodiments. Variations and alterations of the embodiments disclosed herein are possible. All sorts of alternative and equivalent factors in the embodiments are known to those skilled in the art. Those skilled in the art should understand that the present invention can be realized using other forms, structures, arrangements, proportions, and more diverse elements, materials and parts, and the embodiments disclosed here can be alternated and modified without departing from the spirit and scope of the present invention.

I claim:

1. A crystallizer for casting low melting point metals and alloys, comprising:

a base (1), an end mould (2), mould seats (6, 7) on the end mould (2), and film moulds (8, 9), wherein a plurality of position-limiting parts (16) are arranged in the inner side of said mould seats, a slot (17-1) being formed between adjacent position-limiting parts, the shape of the inner side of the position-limiting parts corresponds with that of an outer periphery of mould walls (8-1, 9-1) of the film moulds (8, 9), an inner periphery of the mould walls (8-1, 9-1) corresponds with the outer periphery of a casting, the film moulds (8, 9) are fixed on the mould seats so that the slot (17-1) is closed to become a cycle passage of cooling medium through a medium channel (17);

on the upper end of the medium channel (17) there is a medium-supplying port (5) and the lower end of the medium channel (17) is communicated with a drain pipe (12).

2. The crystallizer according to claim 1, wherein a the plurality of position-limiting parts (16) are cut into the inner side of the mould seats (6, 7) or formed within the inner side of the mould seats (6, 7) as an integrated body.

3. The crystallizer according to claim 1, wherein the plurality of position-limiting parts (16) are arranged in the inner side of the mould seats (6, 7) vertically.

4. The crystallizer according to claim 1, wherein the inner side of the plurality of position-limiting parts (16) is cut by a cutter to form a fringe (21) corresponding with that of the mould walls (8-1, 9-1) of the film moulds.

5. The crystallizer according to claim 4, wherein said cutter is a cylinder (22), whose surface corresponds with the outer periphery of the mould walls (8-1, 9-1) of the film moulds.

6. The crystallizer according to claim 1, wherein the sectional shape of a fringe on the inner side of the position-limiting part (16) is a triangle which is truncated by a cutter and the length of a truncate arc of said position-limiting part is 0.5~6 mm, the arc of the two adjacent fringes truncated by the cutter is 2~50 mm long.

7. The crystallizer according to claim 1, wherein said mould seats (6, 7) have at least two mould closing fits (53, 55, 57, 59) along a mould joint, said film mould (8, 9) consists of the mould walls (8-1, 9-1) and a mould ear (8-2, 8-3, 9-2, 9-3), the mould walls (8-1, 9-1) extend a width along the mould joint to form the mould ear (8-2, 8-3, 9-2, 9-3), which is tightly pressed between the mould closing fits of the mould seats.

8. The crystallizer according to claim 1, wherein the film mould has a locating part which consists of a plurality of inserting slots (23) disposed on the mould closing fits and pins (8-4, 9-4) disposed on mould ears.

9. The crystallizer according to claim 1, wherein the ratio of the thickness of the film moulds to the diameter of a cylindrical casting is between 0.0015~0.006.

10. The crystallizer according to claim 1, wherein the film moulds are made of martensite heat resistant steel.

11. The crystallizer according to claim 1, wherein on the end mould (2) is arranged an upper part (26) which corresponds with the inner periphery of mould walls (8-1, 9-1), the end mould (2) is fixed on the mould base (1), the mould seats (6, 7) slide on the end mould (2); a cylinder (22) cuts the inner side of mould seats (6, 7) to form an inner bottom (25) of the mould seats, the bottom of the film moulds (8, 9) is clamped between the upper part (26) and the inner bottom (25) of the mould seats (6,7).

12. The crystallizer according to claim 1, wherein the drain pipe (12) is communicated to a medium-discharging port (11) through a soft pipe (14); the medium-discharging port (11) is fixed in a liquid level controller (10), and the liquid level controller (10) stops at a determined height or ascends and descends at a determined speed.

13. The crystallizer according to claim 1, wherein at the top of said crystallizer is arranged a top core (71), and an operating mechanism (74) for placing and de-moulding the top core (71), at the top of said crystallizer is arranged a heater (73) for heating the top core.

14. The crystallizer according to claim 13, wherein said top core is made of silicon nitride material.

15. The crystallizer according to claim 1, further comprising: metal moulds (52, 62) imbedded in the space formed after cuffing away a part (49, 50) of the mould seats (6, 7) along a mould joint, wherein the metal moulds (52, 62) have at least two mould closing fits (54, 56, 58, 60) arranged along the mould joint, the shape of the inner side of metal moulds (52, 62) and the inner periphery of mould walls (8-1, 9-1) are combined to form the peripheral shape of a tubular casting.

* * * * *